US005156199A

United States Patent [19]

Hartsell, Jr. et al.

[11] Patent Number: 5,156,199

[45] Date of Patent: Oct. 20, 1992

[54] CONTROL SYSTEM FOR TEMPERATURE COMPENSATED VAPOR RECOVERY IN GASOLINE DISPENSER

[75] Inventors: Hal C. Hartsell, Jr., Kernersville; Kenneth L. Pope, Walkertown, both of N.C.

[73] Assignee: Gilbarco, Inc., Greensboro, N.C.

[21] Appl. No.: 824,702

[22] Filed: Jan. 21, 1992

Related U.S. Application Data

[63] Continuation of Ser. No. 625,892, Dec. 11, 1990, abandoned.

[51] Int. Cl.[5] ..... B65B 3/18

[52] U.S. Cl. ..... 141/83; 141/59; 141/198; 141/44

[58] Field of Search ..... 141/1, 4, 5, 44, 51, 141/59, 83, 192, 198

[56] References Cited

U.S. PATENT DOCUMENTS

| | | | |
|---|---|---|---|
| 3,826,291 | 7/1974 | Steffens | 141/59 |
| 3,850,208 | 11/1974 | Hamilton | 141/59 |
| 3,899,009 | 8/1975 | Taylor | 141/59 |
| 3,941,168 | 3/1976 | Hiller et al. | 141/46 |
| 3,952,781 | 8/1976 | Hiller et al. | 141/46 |
| 3,981,334 | 9/1976 | Deters | 141/46 |
| 4,020,861 | 5/1977 | Shihabi | 137/100 |
| 4,057,085 | 11/1977 | Shihabi | 141/59 |
| 4,068,687 | 1/1978 | Long | 141/59 |
| 4,082,122 | 4/1978 | McGahey | 141/5 |
| 4,197,883 | 4/1980 | Mayer | 141/59 |
| 4,199,012 | 4/1980 | Lasater | 141/52 |
| 4,202,385 | 5/1980 | Voelz et al. | 141/59 |
| 4,223,706 | 9/1980 | McGahey | 141/59 |
| 4,260,000 | 4/1981 | McGahey et al. | 141/59 |
| 4,306,594 | 12/1981 | Planck | 141/59 |
| 4,429,725 | 2/1984 | Walker et al. | 141/59 |
| 5,029,622 | 7/1991 | Mutter | 141/4 |
| 5,038,838 | 8/1991 | Bergamini et al. | 141/59 |
| 5,040,577 | 8/1991 | Pope | 141/59 |

FOREIGN PATENT DOCUMENTS

| | | | |
|---|---|---|---|
| 3903603 | 8/1990 | Fed. Rep. of Germany | 141/59 |
| 2226812 | 7/1990 | United Kingdom . | |

*Primary Examiner*—Ernest G. Cusick
*Attorney, Agent, or Firm*—Rhodes, Coats & Bennett

[57] ABSTRACT

A system for recovering vapor emerging from a tank to which liquid is being delivered wherein a vapor pump sucks vapor from the tank with a volumetric flow that is equal to the volumetric flow of the liquid as modified so as to compensate for the change in volume of the emerging vapor caused by its proximity to the entering liquid, and apparatus for measuring the actual vapor flow and adjusting the volumetric flow of the vapor pump so that it is equal to the flow required for ideal compensation.

10 Claims, 2 Drawing Sheets

CONTROL SYSTEM FOR TEMPERATURE COMPENSATED VAPOR RECOVERY IN GASOLINE DISPENSER

This application is a continuation of application Ser. No. 07/625,892 filed Dec. 11, 1990 abandoned.

RELATED APPLICATIONS

U.S. patent application entitled "Vapor Recovery System For Fuel Dispenser" filed on Dec. 4, 1989, in the name of Roger W. Furrow and Kenneth L. Pope, and bearing Ser. No. 07/445,384 now abandoned.

U.S. patent application entitled "Vapor Recovery System for Fuel Dispenser" filed on May 21, 1990, in the name of Kenneth L. Pope, and bearing Ser. No. 07/526,303 now Patent No. 5,040,577.

FIELD OF THE INVENTION

The field of the present invention relates generally to fuel dispensers, and more particularly to vapor recovery systems for use when dispensing a volatile fuel such as gasoline.

BACKGROUND OF THE INVENTION

The U.S. patent application referred to above that bears Ser. No. 07/445,384 describes a vapor recovery system for use with fuel dispensing apparatus in which vapor and any fluid emerging from a tank being filled, are drawn into a vapor return path of a hose, where they are sucked out via a tube having a small enough passageway to entrain the liquid.

The U.S. patent application referred to above that bears Ser. No. 07/526,303, describes a vapor recovery system in which the speed of the vapor recovery pump is set by a microprocessor rather than mechanical means so that its volumetric flow is equal to the volumetric flow of liquid into a tank. In one embodiment the volumetric flow of the vapor recovery pump is modified so as to maintain an expected pressure at its input. In another, the volumetric flow of the vapor recovery pump is modified so that it maintains an expected volumetric flow.

BRIEF SUMMARY OF THE INVENTION

In dispensing systems for vaporizable liquid, the liquid flows to the tank being filled through a tube and vapor is sucked by a recovery pump from the tank via an adjacent tube. If the temperature of the liquid and the temperature of the vapor in the tank are the same, the volumetric flow $V_R$ of the vapor recovery pump can be made equal to the volumetric flow of the liquid, $V_L$. However, if the temperatures are different, a heat exchange takes place between the liquid and the vapor in the vehicle tank so that the vapor expands or contracts in accordance with the universal gas law PV=mRT. Therefore, in order, to evacuate all of the vapor that is displaced from the tank as the liquid enters it and yet not suck in excess air by sucking too hard, the volumetric flow of the vapor recovery pump must be varied. By way of example, if the temperature of the vapor in the tank being filled is colder than the liquid being pumped into it from an underground reservoir, as may well occur during winter, the vapor in the vehicle tank will be heated and will expand, thereby requiring an increase in the volumetric flow of the vapor pump. The opposite effects may take place during the summer.

The volumetric flow of $V_R$ of the vapor recovery pump as a function of the volumetric flow, $V_L$, of the liquid, the temperature $T_V$ of the vapor in the tank, and the temperature $T_L$ of the liquid can be expressed as follows in equation (1):

$$V_R = V_L \frac{[T_L + a(T_V - T_L)]}{T_V} \quad (1)$$

wherein $T_L$ and $T_V$ are absolute temperature and "a" is an empirical constant accounting for the degree to Which the temperature of the vapor at the exit of the fill pipe approaches the temperature, $T_L$, of the liquid. Thus, for example, if the vapor is heated to the temperature of the liquid, "a" is zero. If one assumes the heat transfer process to be 100% efficient, then "a"=0, and therefore, $V_R$ is computed as shown below in equation (2):

$$V_R = V_L \frac{T_L}{T_V} \quad (2)$$

Ideally, the temperature of the liquid flowing into the vehicle tank $T_L$, and the initial temperature of the vapor in the vehicle tank $T_V$ would be measured directly in computing $V_R$ from equation 1. Appropriately located conventional transducers would be used in making the temperature measurements. If $T_L$ is at substantially the same temperature as $T_V$, then from either equation (1) or (2), $V_R=V_L$. Also, in a practical system, one would typically use the ambient or atmospheric temperature as an estimate of the initial vapor temperature $T_V$. A thermistor or other appropriate type transducer, for example, mounted in the product flow path would be used to measure the product temperature $T_L$.

In most situations the initial temperature, $T_V$, of the vapor in the tank being filled is approximately the same as the atmospheric or ambient temperature $T_A$.

In accordance with another aspect of this invention, compensation is made for any difference between the actual volumetric flow, $V_A$, of the recovery pump and the ideal flow, $V_R$, that can be caused by such things as pump wear and differences between pumps due to variations within tolerance limits. This is accomplished by measuring the actual flow $V_A$, deriving the difference between it and $V_R$, and controlling the recovery pump so that $V_A=V_R$.

DETAILED DESCRIPTION OF THE INVENTION

Figure 1:
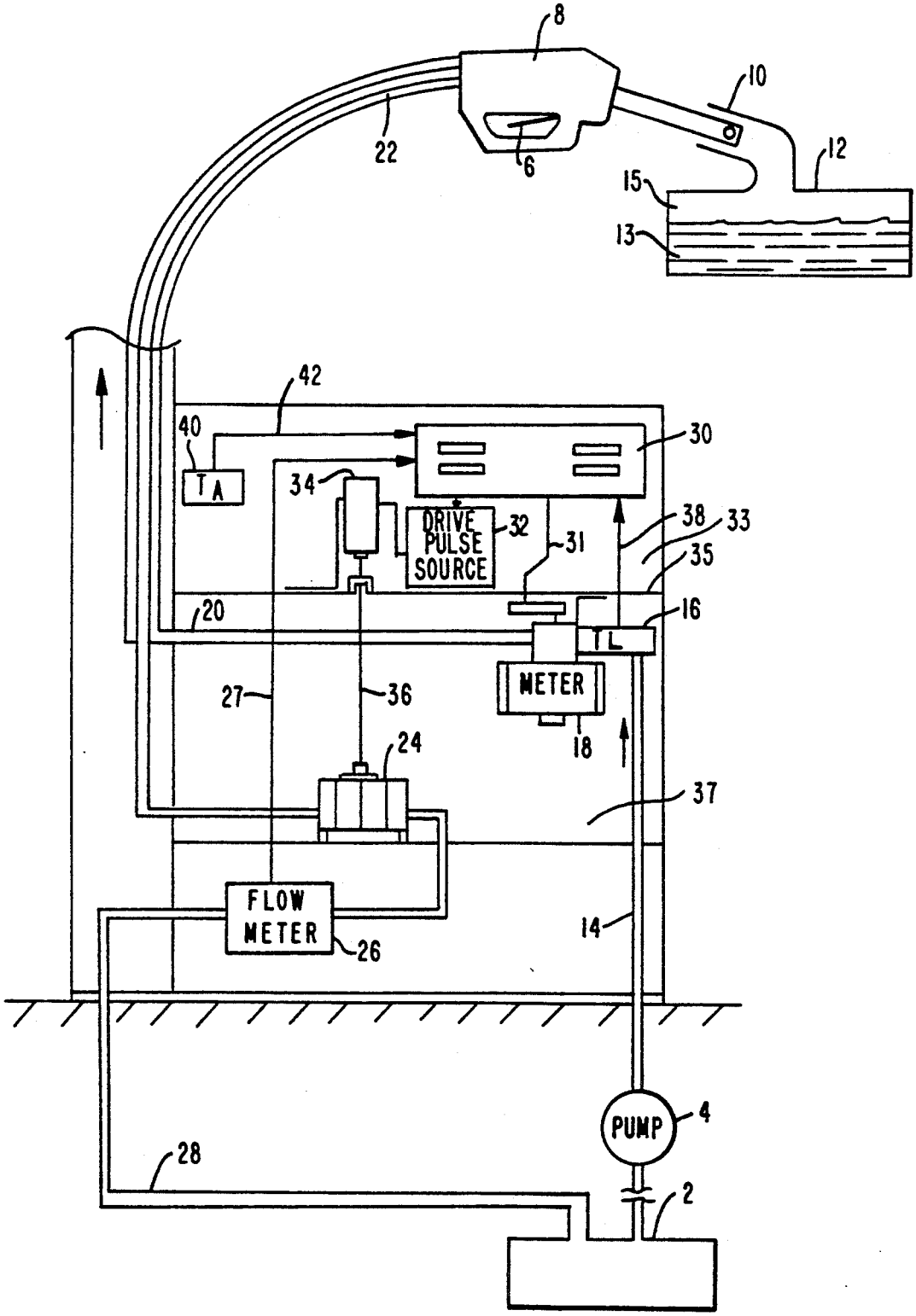
FIG. 1 is a schematic representation of the delivery system for volatile liquid constructed in accordance with the invention.

In the embodiment of the invention shown in FIG. 1, liquid is pumped from a reservoir 2 by a pump 4 with a volumetric flow $V_L$ that is determined in a manner, not shown, by the position of a trigger 6 of a nozzle 8. The nozzle 8 may be constructed as described in U.S. Pat. No. 4,199,012, for example, and is inserted into the fill pipe 10 of a tank 12 that is to be filled with liquid 13. The liquid flows to the nozzle from the pump 4 via a tube 14, a temperature transducer 16, a flow meter 18, and a tube 20. As vapor 15 is forced from a tank 12, it is drawn through a tube 22 by a recovery pump 24 that forces it through a flow meter 26 and a tube 28 to the reservoir 2.

As described below, means are provided for initially driving the recovery pump 24 at such speed that its volumetric flow, $V_V$, equals the volumetric flow, $V_L$, of the liquid produced by the pump 4. Signals from the flow meter 18 are applied via a lead 31 to a microprocessor 30 that is programmed to supply a control signal to a drive pulse source 32 that supplies drive pulses to a stepping motor 34. The stepping motor 34 is mechanically coupled via a rod 36 to drive the recovery pump 24. The frequency of the drive pulses supplied by the source 32 is such that the motor 34 drives the recovery pump 24 at such a speed a to cause $V_V=V_L$.

The volumetric flow of the recovery pump 24 may be modified as follows to accommodate the change in volume of the vapor emanating from the tank 12. The signal provided by the temperature transducer 16 representing the temperature, $T_L$, of the liquid flowing to the tank 12 is conducted to the microprocessor 30 via a lead 38. A temperature transducer 40 supplies a signal representing the atmospheric or ambient temperature $T_A$ to the microprocessor 30 via a lead 42. The microprocessor 30 modifies the control signal supplied in the drive pulse source 32 in a manner described in FIG. 2 so as to change the nominal volumetric flow $V_V$ of the recovery pump 24 to the ideal value $V_R$.

Figure 2:
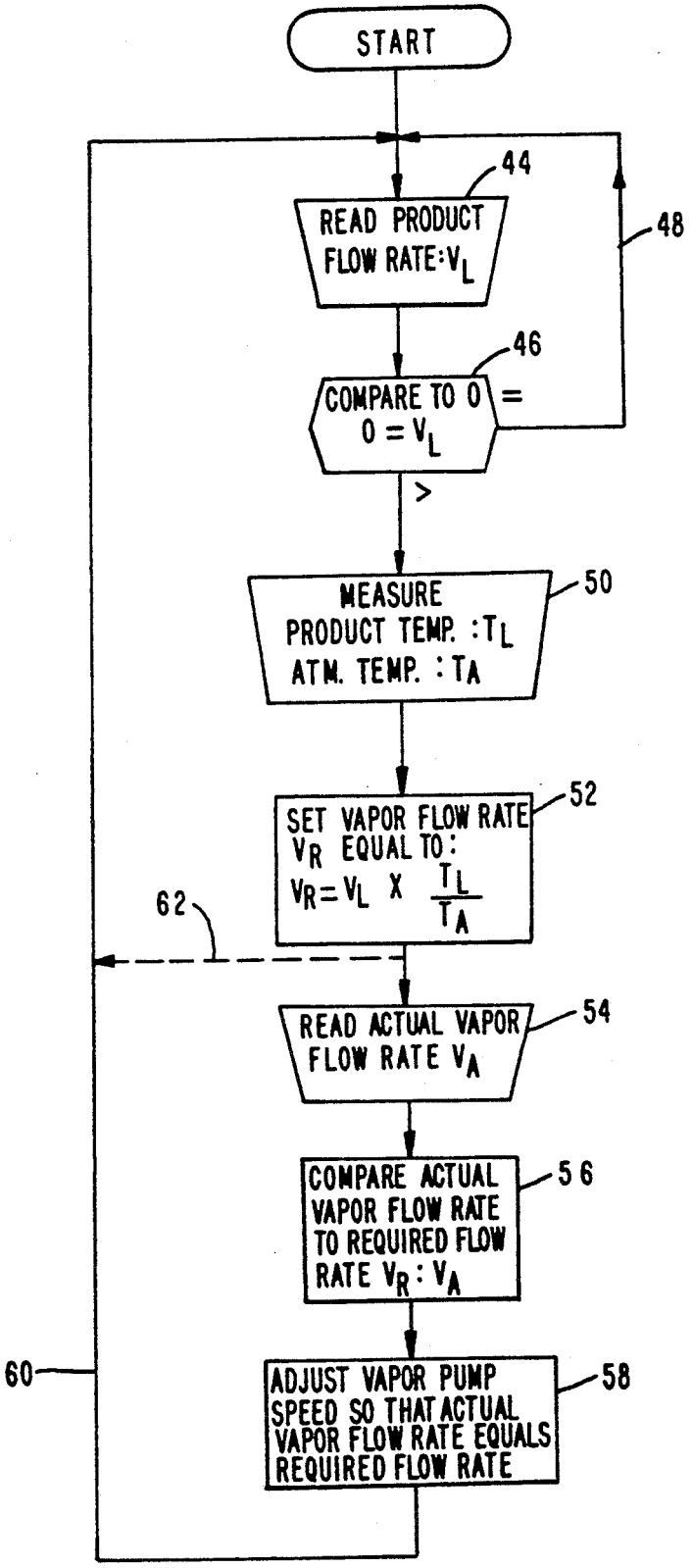
FIG. 2 is a flow chart used in explaining the operation of the delivery system shown in FIG. 1.

Reference is now made to the flow chart of FIG. 2. At the start of the program, the microprocessor 30 reads the signal $V_L$ on the lead 31 as indicated by a block 44. A determination is made as to whether any liquid is flowing by comparing $V_L$ with zero, block 46. If $V_L=0$, the processes return to the block 44, via line 48.

When block 46 indicates that $V_L<0$, a block 50 indicates that the microprocessor 30 reads the signals on the leads 38 and 42 respectively representing the temperature, $T_L$, of the liquid and the temperature, $T_A$, of the atmosphere. In block 52, the signal supplied to the pulse drive source 32 is changed if required to a value as shown below in equation (3):

$$V_R = V_L \frac{T_L}{T_A} \tag{3}$$

Alternatively, the signal supplied to the drive pulse source 32 could be such that $V_R$ is as shown below in equation (4):

$$V_R = V_L \frac{[T_L + a(T_V - T_L)]}{T_V} \tag{4}$$

Thus far, it has been assumed that the actual volumetric flow $V_A$ of the recovery pump 26 corresponds precisely to the ideal value $V_R$, but, as indicated previously, this may not always be the case because of differences between pumps and wear. If desired, the ideal value of $V_R$ can be attained by the microprocessor reading the signal on the lead 27 representing actual vapor flow, $V_A$, as indicated by block 54, comparing it with the ideal value $V_R$, which it has computed from $T_L$, $T_A$ and if need be by block 56, and changing the signal supplied to the drive pulse source 32 to a value such that $V_A=V_R$, as indicated by a block 58. The process then returns to the start at the block 44.

Note that in the embodiment of the invention shown in FIG. 1, the electrical apparatus is enclosed in a non-hazardous zone 33 above a vapor barrier 35. The fluid handling mechanical apparatus are enclosed below vapor barrier 35 in a hazardous zone 37. Such an arrangement is useful for a gasoline dispenser, for example.

If correction for deviation of the actual volumetric flow, $V_A$, from the ideal volumetric flow is not desired, the procedure can be returned to its start after the block 52 as indicated by the dashed line 62. In either case, the process is repeated rapidly enough to follow changes in the volumetric flow of liquid $V_L$ as well as changes in other parameters such as $T_L$ and $T_A$.

Although various embodiments of the invention have been illustrated and described herein, they are not meant to be limiting. Modifications to these embodiments may become apparent to those of skill in the art, which modifications are meant to be covered by the spirit and scope of the appended claims.

What is claimed is:

1. A liquid delivery system, comprising:

a liquid delivery path adapted for engagement with a tank to be filled, means for delivering liquid to the tank along said liquid delivery path with a variable volumetric flow;

means for providing and electrical signal indicative of said volumetric flow;

a second path that is adjacent to said liquid delivery path;

vapor recovery means responsive to said electrical signal for sucking vapor from the tank along said second path with a nominal volumetric flow corresponding to the volumetric flow;

means for deriving second and third signals respectively representing the absolute temperatures of liquid in said liquid delivery path and vapor entering said second path; and means responsive to said second and third signals for increasing the volumetric flow of the vapor recovery means when the temperature of the liquid is greater than the temperature of vapor and for decreasing the volumetric flow to the vapor recovery means when the temperature of the liquid is less than the temperature of vapor.

2. A liquid delivery system as set forth in claim 1 further comprising:

means for determining from said second and third signals an indication of the ideal volumetric flow of vapor required to remove the vapor displaced from the tank by delivery of the liquid thereto;

means for providing an indication of the actual volumetric flow of vapor produced by said vapor recovery means; and means responsive to said indication of the ideal vapor flow and the indication of the actual vapor flow for modifying the volumetric flow produced by said vapor recovery means so that it is equal to the ideal volumetric flow.

3. For a fuel dispensing system, the method comprising the steps of:

delivering fuel to a tank along a first path with a variable volumetric flow;

producing an electrical signal indicative of the volumetric flow;

sucking vapor from the tank in response to the electrical signal, along a second path that is adjacent to the first path with a nominal volumetric flow corresponding to the volumetric flow;

producing second and third signals respectively representing the absolute temperatures of fuel in the first path and vapor entering the second path; and increasing the volumetric flow of the vapor being sucked, in response to said second and third signals, if the temperature of the fuel is greater than the temperature of vapor and decreasing the volumetric flow of the vapor being sucked, in response to said second and third signals, if the temperature of the fuel is less than the temperature of vapor.

4. The method of claim 3, further comprising the steps of:

calculating from said second and third signals an indication of the ideal volumetric flow of vapor required to remove the vapor displaced from the tank by delivery of the fuel thereto;

producing an indication of the actual volumetric flow of vapor produced by sucking back vapor at a given time; and adjusting the volumetric flow of sucking back vapor in response to said indication of the ideal vapor flow and the indication of the actual vapor flow for equating the rates of actual vapor flow and ideal vapor flow.

5. A fuel delivery system comprising:

a first conduit, a fuel delivery pump adapted for withdrawing fuel form a fuel reservoir and forcing it along said first conduit;

a meter coupled to said first conduit for providing a first signal indicative of the volumetric flow of fuel in said first conduit;

a second conduit, a vapor recovery pump for withdrawing vapor along said second conduit;

driving means for said vapor recovery pump;

a controller responsive to said first signal for causing said driving means to drive said vapor recovery pump so that is has an initial nominal volumetric flow corresponding to the volumetric flow of fuel in said first conduit;

a first transducer means for deriving a second signal indicative of the temperature of fuel in said first conduit;

a second transducer means for deriving a third signal indicative of the temperature of vapor in said second conduit; and said controller also being responsive to said second and third signals for deriving a motor control signal which when applied to said driving means modifies the initial nominal volumetric flow provided by said vapor recovery pump in such manner as to reduce the difference int he volume of vapor emerging from a tank to which fuel is being delivered and the volume of the vapor passing through said vapor recovery pump.

6. A system as set forth in claim 5, further comprising:

a housing;

a vapor barrier mounted in said housing that divides it into non-hazardous and hazardous zones;

said fuel delivery pump, said meter, said first conduit, and said first transducer means for deriving said second signal being within said hazardous zone;

said vapor recovery pump and said second conduit being within said hazardous zone;

said controller and said driving means being within said non-hazardous zone;

means for coupling said second signal from said first transducer means to said controller through said vapor barrier; and mechanical means extending through said vapor barrier for coupling said driving means for said vapor recovery pump to said vapor recovery pump.

7. A system as set forth in claim 6, further comprising:

a flow meter coupled to said second conduit for providing a fourth signal indicative of the volumetric flow of vapor through said second conduit;

means for coupling said fourth signal through said vapor barrier to said controller; and said controller being programmed to provide a signal to said driving means so as to further modify the volumetric flow of said vapor recovery pump in such manner that it actually equals the amount theoretically required to compensate for the difference in volume of vapor emerging from the tank to which fuel is being delivered and the volume of the vapor passing through the vapor recover pump.

8. A fuel delivery system as set forth in claim 7, further comprising:

a hose having a first tube having one end coupled to a nozzle and the other end coupled to said first conduit and a second tube having one end coupled to said nozzle and the other end coupled to said second conduit; and said nozzle having manually controllable means for varying the volumetric flow of said fuel delivery pump.

9. A liquid delivery system as set forth in claim 1 wherein said means for deriving said third signal includes a thermal transducer exposed to ambient air.

10. A fuel delivery system as set forth in claim 5 wherein said second transducer is exposed to ambient air.

* * * * *

UNITED STATES PATENT AND TRADEMARK OFFICE

CERTIFICATE OF CORRECTION

PATENT NO. : 5,156,199
DATED : October 20, 1992
INVENTOR(S) : Hal C. Hartsell

It is certified that error appears in the above—identified patent and that said Letters Patent is hereby corrected as shown below:

Column 4, Line 43 replace "to" with --of-- to read:
"the volumetric flow of the vapor..."

Column 5, Line 30 replace "form" with --from-- to read:
"from a fuel reservoir..."

Column 5, Line 41, replace "is" with --it-- to read:
"so that it has an initial..."

Signed and Sealed this

Twenty-third Day of November, 1993

*Attest:*

Bruce Lehman

BRUCE LEHMAN

*Attesting Officer*

*Commissioner of Patents and Trademarks*